United States Patent [19]

Höfer et al.

[11] 4,312,312

[45] Jan. 26, 1982

[54] FUEL INJECTION PUMP FOR INTERNAL COMBUSTION ENGINES

[75] Inventors: Gerald Höfer, Weissach-Flacht; Manfred Schwarz, Gerlingen; Karl Konrath, Ludwigsburg, all of Fed. Rep. of Germany

[73] Assignee: Robert Bosch GmbH, Stuttgart, Fed. Rep. of Germany

[21] Appl. No.: 81,249

[22] Filed: Oct. 2, 1979

[30] Foreign Application Priority Data

Oct. 14, 1978 [DE] Fed. Rep. of Germany ..... 2844910

[51] Int. Cl.[3] ..... F02D 31/00

[52] U.S. Cl. ..... 123/340; 123/366; 123/368; 123/502

[58] Field of Search ..... 123/340, 365, 366, 368, 123/379, 449, 502, 503

[56] References Cited

U.S. PATENT DOCUMENTS

| | | | |
|---|---|---|---|
| 1,935,507 | 11/1933 | Kuttner | 123/366 |
| 3,015,326 | 1/1962 | Wirsching et al. | 123/340 |
| 3,421,486 | 1/1969 | Parrish, Jr. | 123/449 |
| 3,640,259 | 2/1972 | Garcea | 123/365 |
| 3,727,598 | 4/1973 | Knapp | 123/365 |
| 3,924,594 | 12/1975 | Aoki | 123/365 |
| 4,143,634 | 3/1979 | Ritter et al. | 123/366 |

FOREIGN PATENT DOCUMENTS

| | | | |
|---|---|---|---|
| 530668 | 12/1940 | United Kingdom | 123/365 |

OTHER PUBLICATIONS

Bosch, Distributor-Type Injection Pump, 1976.

*Primary Examiner*—Ira S. Lazarus
*Assistant Examiner*—Magdalen Moy
*Attorney, Agent, or Firm*—Edwin E. Greigg

[57] ABSTRACT

The invention relates to a fuel injection pump in which, via an appropriate transducer, the temperature of the coolant of the internal combustion engine intervenes as a control value in the fuel injection pump regulation, in that at least two of the following three final control elements are simultaneously adjusted: A for the injection onset adjustment; B for the increased starting quantity; or C for the idling rpm.

18 Claims, 7 Drawing Figures

FUEL INJECTION PUMP FOR INTERNAL COMBUSTION ENGINES

BACKGROUND OF THE INVENTION

The invention relates to a fuel injection pump for an internal combustion engine, having a cam drive effecting the delivery movement of at least one fuel pump piston.

In a known fuel injection pump, by means which function independently of each other, an increased fuel quantity during starting, an idling rpm, and not least an rpm-dependent adjustment of injection are attained. However, Diesel engine manufacturers increasingly require an intervention to be made into the regulation process of the injection pump in accordance with the engine temperature. It is already known, for instance, to vary the zero or rest position of the adjustment lever of the injection pump via an expansion-element regulator and a Bowden cable to attain a decrease in the idling rpm, as the engine temperature increases. It is also known to control the adjustment piston of a hydraulic injection adjuster toward "early" during cold starting, via a thermostat. It is further known to reduce the increased starting quantity via a thermostat when the starting temperature is increasing. All of these interventions taken singly are clearly understandable and therefore, when taken singly, attain their respective objects. In many cases, however, the application of only one of these known means is insufficient, yet the use of more than one would make the injection pump too large because of the required attachments and too expensive because of the many additional elements required for proper operation thereof. In addition, there is still the problem of adapting the various control values to one another because of the various transducers and converters.

OBJECT AND SUMMARY OF THE INVENTION

It is an object of the invention to provide a fuel injection pump in which several temperature-related interventions in the injection pump regulation can be made in the simplest manner, with an assured and simple adaptation of the individual control values to one another.

It is a further object of the invention to provide a basic fuel injection pump apparatus having the capacity for several kinds of regulation intervention which can be inexpensively mass produced, so that the engine manufacturer to whom the pump is delivered can, as needed, utilize one or all of the possible kinds of regulation intervention. In many cases, an engine which is especially equipped, such as one with turbo-charging, can thus be equipped with the same basic type of injection pump as can the same standard engine type.

The fuel injection pump, according to the invention, includes a final control device which is controllable by engine temperature, and which simultaneously adjusts at least two of three control elements influencing the injection. This final control device may be used to simultaneously adjust a first element for attaining an early injection onset when the engine is cold, and/or a second element for decreasing the starting fuel quantity as temperature increases, and/or a third element for reducing the idling rpm as temperature increases.

In the dependent claim, various embodiments and improvements of the invention as given in the main claim are disclosed.

The invention will be better understood as well as further objects and advantages thereof become more apparent from the ensuing detailed description of the preferred embodiments taken in conjunction with the drawings.

DESCRIPTION OF THE PREFERRED EMBODIMENTS

Figure 1:
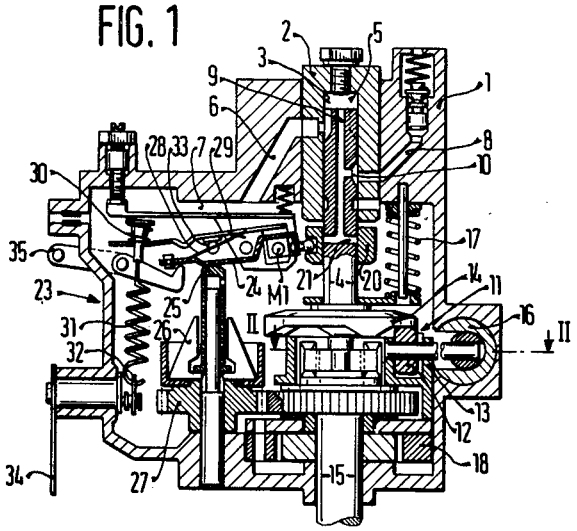
FIG. 1 is a cross-sectional view of a fuel injection pump to which the invention has been applied.

Turning now to the fuel injection pump shown in FIG. 1, a sleeve 2 is disposed in a housing 1 and has a central blind bore 3, in which a pump piston 4 performs a simultaneously reciprocating and rotating movement. The pump work chamber 5 formed in the blind bore 3 is supplied with fuel during the suction stroke of the pump piston 4 via an intake bore 6 from the intake chamber 7 disposed in the pump housing 1 and is arranged to pump the fuel during the compression stroke via lines 8, of which only one is shown, to the fuel injection nozzles located on the internal combustion engine. A central bore 9 in the pump piston 4 and a longitudinal distributor groove 10 on the jacket surface of the pump piston 4 serve to supply fuel and distribute it to the pressure lines 8.

The pump piston 4 is driven via a cam drive 11, which has a cam ring 13, bearing rollers 12 and a disc 14 with cams on one face which are arranged to run on the rollers 12. The cam disc 14 and the pump piston are coupled with the drive shaft 15 via a rotary coupling (not shown). The cam ring 13 supported within the housing 1 is rotatable over several angular degrees via a piston injection adjuster 16 in order to adjust the beginning of injection. The stroke drive of the pump piston 4 is accomplished against the force of a restoring spring 17.

The intake chamber 7 disposed in the housing 1 and the injection adjuster 16 are supplied with fuel by means of a fuel supply pump 18. The fuel pressure is controlled in accordance with rpm and effects a corresponding adjustment of the hydraulic piston of the injection adjuster 16.

An annular slide 20 disposed about the piston 4 which controls the discharges of a transverse bore 21 of the longitudinal bore 9 in the pump piston 4 serves to control the injection quantity. The higher the control slide 20 is disposed, the later the transverse bore 21 is opened; that is, the greater is the injection quantity, and vice versa. The control slide 20 is displaced by means of a mechanical rpm governor 23. The rpm governor 23 has a starting lever 24 supported at M1, which is directly engaged by the adjustment sleeve 25 of a centrifugal adjuster which works by means of flyweights 26. The centrifugal adjuster is driven via a gear drive 27. The starting lever 24 is supported via a relatively soft starting spring 28 on a tension lever 29, which is also supported at M1 and is driven, upon a corresponding stroke of the adjustment sleeve 25, by the starting lever 24 in the manner of a drag member. However, as soon as the starting lever 24 contacts the tension lever 29, stress is placed first on an idling spring 30 and thereafter on a control spring 31. In the order of their becoming effective, the springs 28, 30, 31 are disposed in series one after the other. Because the idling spring 30 is softer than the control spring 31, the lower suspension point 32 of the control spring 31 determines the prestressing of the idling spring 30 when the tension lever 29 is in the position of rest corresponding to idling; this position of rest is determined by a stop 33. The prestressing in turn of the control spring 31 is determined by an adjustment lever 32, which is actuated by the driver and, depending on its position, causes a variation in the ratio of the injection quantity to the rpm.

Further engaging the starting lever 24 is the shutoff lever 35, through which, with a corresponding displacement, the starting lever 24 and tension lever 29 are rotated into a position for which the control slide 20 is slid downward to such an extent that no further injection can take place. This lever 35 furthermore represents a stop for the largest possible increased starting quantity. With a small amount of rotation of the shutoff lever 35, the starting position of the control slide 20 varies accordingly and thus so does the increased starting quantity vary. Should an increased starting quantity not be desirable, for instance in the event that the engine is warm, then, upon starting, the starting lever 24 is displaced directly against the tension lever 29 by means of the lever 35, so that no increased starting quantity is delivered to the engine.

In order to be able to control idling or the increased starting quantity, respectively, in accordance with the engine temperature, it is sufficient to vary the initial position of the shutoff lever 35 or the starting lever 24 in the one case, or to vary the suspension point 32 or the initial position of the adjustment lever 34 in the second case, by means of a stop which functions in accordance with temperature. At the shutoff lever 35, the possible length of the lever travel path is reduced with increasing temperature; in the case of the adjustment lever 34, the path length is increased with increasing temperature. The purpose of the latter is to attain greater relief with increasing temperature when the idling spring 30 is in the zero position. As a result of the relief, the shutoff rpm in idling is set at a lower rpm level.

Figure 2:
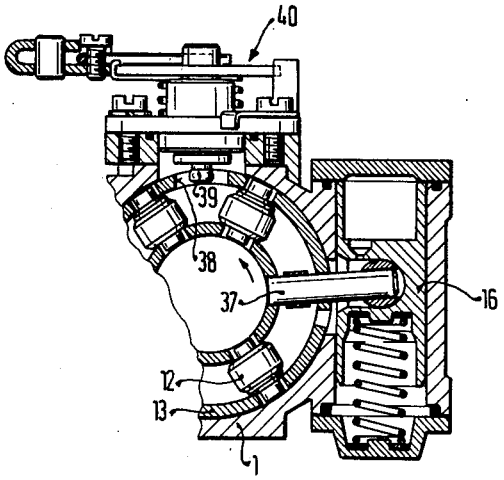
FIG. 2 is a fragmentary sectional view through the pump taken along the line II—II of FIG. 1.

In FIG. 2, the cam drive of the pump is shown along the line II—II of FIG. 1. The cam ring 13 with the rollers 12 is rotated by means of the hydraulic injection adjustment piston 16 in the housing 1 via a stub shaft 37. However, an eccentric member 39 of an adjustment device 40 also engages a groove 38 of the cam ring 13. As a result, particularly in the event of a cold start, the cam ring 13 can be adjusted automatically toward early injection. However, it is as equally well conceivable that an early adjustment should directly engage the adjustment piston 16 of the injection adjuster and displace it toward "early" in the case of the cold engine. This early adjustment is advantageously attained via a thermostat, or some comparable temperature-dependent adjustment device. Naturally it is also conceivable that this early adjustment should take place via the control means of the hydraulic pressure which is exerted upon the piston 16. What is decisive is that the rotation of the cam ring 13 toward "early" is derived from a temperature transducer, which effects the identical adjustment proportion at the governor for the purpose of variation of the increased starting quantity or the idling rpm.

Figure 3:
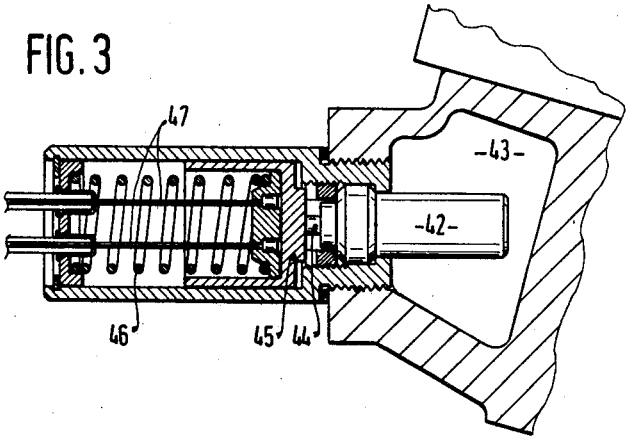
FIG. 3 shows a sectional view of a transducer projecting into the block of an engine and arranged to detect the engine temperature.

In FIG. 3 there is shown a transducer 42 disposed on the engine supplied by the fuel injection pump. This transducer, embodied as a so-called expension-element regulator, projects into a chamber 43 provided in the block of the engine which has coolant flowing through it. This expansion-element regulator 42, with increasing temperature, progressively displaces a piston 45 via a tang 44, against the force of a spring 46. Two Bowden cables 47 are secured on a member that is in abutting relation with the piston 45, so that a synchronous or simultaneous triggering can take place of the backing-off movement of the shutoff lever 35 and adjustment lever 34, or of the early adjustment of the injection adjuster. Naturally, it is also possible that only two of the above interventions should be performed via this temperature transducer. However, in accordance with the invention, the pump can also be triggered by means of a transducer via only a single Bowden cable, in which case at least two and possibly all three of the control interventions described can be accomplished.

Figure 4:
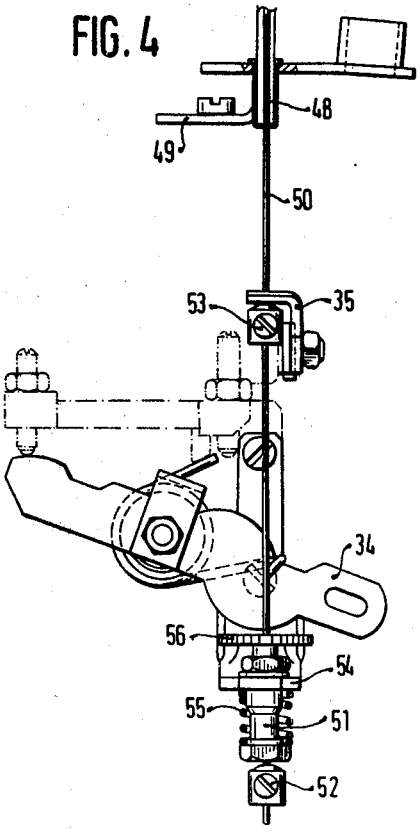
FIGS. 4 and 5 show final control elements for control of idling and of increased starting quantity.
Figure 5:
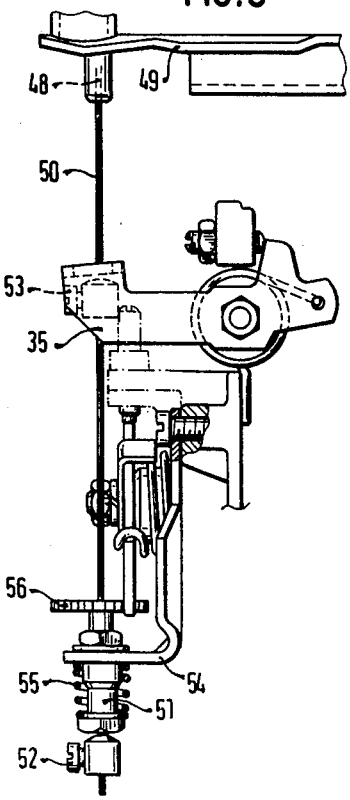

An example of such an embodiment having only one Bowden cable is shown in FIGS. 4 and 5 which are views taken at 90° one relative to the other. The pump itself is visible only in broken lines. The end of a Bowden cable 48 which extends toward the pump, the other end of which is connected to the temperature transducer on the engine, is secured via an angle bracket 49 to the pump. The cable 50 of the Bowden cable is inserted through the eye of a guide bolt 51 and secured on its end by a clamp screw 52. In the intervening portion where the cable extends freely, a further fastening screw 53 is provided which serves as a stop which determines or varies the initial position of the shutoff lever 35.

The fixing screw 52, in contrast, acts upon the bolt 51, which is axially displaceable, against the force of a spring 55, in an angle bracket 54 secured on the pump housing. Located on this bolt 51 is a stop plate 56, which extends or restricts the path of the adjustment lever 34. As a result, there is a simultaneous intervention into the control of idling and of increased starting quantity. Via the second Bowden cable of FIG. 3, which is simultaneously actuated, an intervention can be made in corresponding fashion into the adjustment of fuel injection. However, it is also entirely possible to preclude the intervention into the starting quantity, for example, by means of displacement of the stop screw 53.

Figure 6:
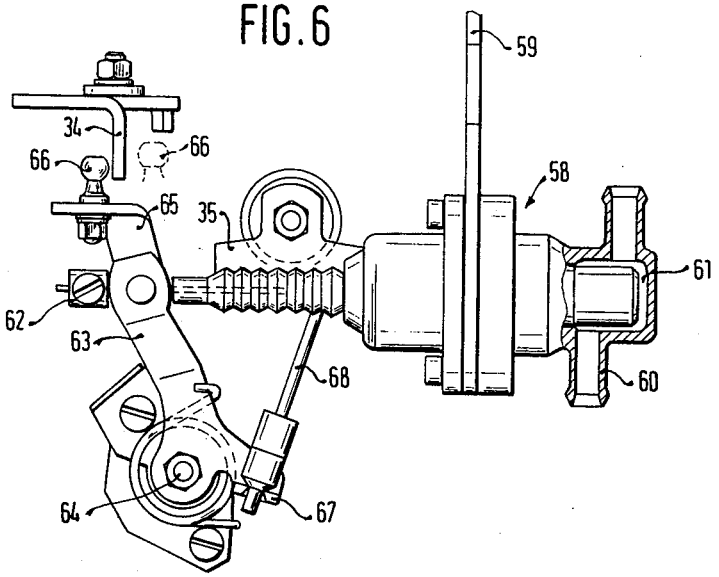
FIGS. 6 and 7 show final control elements for control of injection onset, idling, and increased starting quantity, as well as a thermostatic control apparatus.
Figure 7:
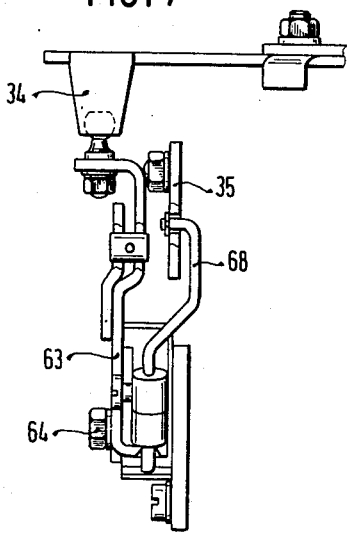

In the second exemplary embodiment shown in FIGS. 6 and 7, the thermostatic transducer 58, which may be embodied fundamentally like that of FIG. 3, is disposed directly on the fuel injection pump. A sheet-metal clamp 59 accomplishes this purpose. The coolant of the engine is delivered via conduit (not shown) and nipples 60 to a chamber 61, into which the expansion-element regulator projects. The expansion-element regulator, either directly or via a Bowden cable as in the previous example, actuates a fastening member 62, which acts upon a lever 63, which in turn engages the cam ring 13, either via the eccentric 40 as in FIG. 2 or as already mentioned by means of adjustment of the hydraulic piston 16 of the injection adjuster. In each case, a shaft 64 is rotated to this end by means of the lever 63. Disposed in the extension of the lever 63 is an angularly bent strip of metal 65, which in turn supports a ball head 66 which acts as a stop for the adjustment lever 34. The full-line illustrated position applies to the warm engine; when the engine is cold, the ball head 66 assumes the position illustrated in broken lines. On the side of the lever 63 remote from the shaft 64, there is a coupler strip 67, which is coupled via a rod 68 with the shutoff lever 35 in the manner of a drag member, so that when the engine is cold, the lever path is longer than it is in the illustrated position.

Naturally, an electromagnetic transducer, which is triggered via a temperature measurement transducer, can also be used.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection pump for internal combustion engine, which includes:

a pump housing;

at least one pump piston;

a cam drive means for effecting a fuel delivery movement of said at least one pump piston, said cam drive means including a revolving first part and a second part which is supported in said pump housing and which is rotatable within said housing about said revolving first part along a predetermined arcuate path, the position of said second part determining onset of fuel injection;

a first final control means for controlling onset of fuel injection, which includes said second part of said cam drive means;

a fuel supply quantity adjustment means for determining the quantity of fuel injection;

an adjustment lever coupled to arbitrarily actuate said fuel supply quantity adjustment means, which is arbitrarily movable along a predetermined path from a rest or idling position to increase the quantity of fuel injected; and an rpm governor means for actuating said fuel supply adjustment means, which includes a second final control means for controlling fuel quantity injected during engine starting, and a third final control means for controlling fuel quantity injected during engine idling;

a final control adjustment means which includes a thermostatic transducer for simultaneously adjusting at least two of said first, second and third final control means in accordance with engine temperature;

wherein when said first final control means is connected to and adjusted by said thermostatic transducer, the injection onset is adjusted toward early onset as engine temperature decreases;

wherein, when said second final control means is connected to and adjusted by said thermostatic transducer means, the starting fuel quantity is decreased as the engine temperature increases; and wherein, said third final control means includes an idling spring means of said rpm governor which is connected to position said fuel quantity adjustment means during engine idling; and further comprises a first adjustable stop for said adjustment lever, said first stop being connected to said thermostatic transducer which determines the position of said stop, the position of said stop determining the idling position of said adjustment lever by limiting the path of travel in one direction of said adjustment lever; and wherein, said thermostatic transducer is coupled to said idling spring means to adjust said third final control means by varying prestressing of said idling spring during engine idling such that the fuel quantity at engine idling is decreased as engine temperature increases.

2. A fuel injection pump, as described in claim 1, wherein said second part of said cam drive means comprises a rotatable cam ring which is directly coupled to said final control adjustment means.

3. A fuel injection pump, as described in claim 1, wherein said second part of said cam drive means comprises a rotatable cam ring, said first final control means further comprising an hydraulic piston means, actuated by said first final control means, for positioning said cam ring.

4. A fuel injection pump, as described in claim 1, wherein:

said pump housing and said pump piston define a pump work chamber;

said pump piston defines a pressure relief passage extending from said pump work chamber through said piston, said relief passage being closed by said fuel supply quantity adjustment means during fuel injection and said relief passage being opened by said fuel supply quantity adjustment means to stop the fuel injection; and said final control adjustment means acts directly on said fuel quantity control means to control fuel quantity injected during engine starting.

5. A fuel injection pump, as described in claim 1, wherein:

said pump housing and said pump piston define a pump work chamber;

said pump piston defines a pressure relief passage extending from said pump work chamber through said piston, said relief passage being closed by said fuel supply quantity adjustment member during fuel injection and said relief passage being opened by said fuel supply quantity adjustment member to stop the fuel injection;

said second final control means includes a starting lever means of said rpm governor, for modifying the function of the rpm governor whereby opening of said relief passage is delayed or prevented to increase fuel injection quantity when the engine is started; and said final control adjustment means acts upon said starting lever means to adjust said second final control means in accordance with engine temperature.

6. A fuel injection pump, as described in claim 1, wherein:

said transducer is secured directly to the engine; and said final control adjustment means includes at least one Bowden cable for coupling said transducer to at least two of said first, second and third final control means.

7. A fuel injection pump, as described in claim 1, wherein said transducer is secured on said fuel injection pump.

8. A fuel injection pump, as described in claim 1, wherein said final control adjustment means includes a first Bowden cable for connecting said transducer to actuate said first final control means; and a second Bowden cable for connecting said transducer to actuate at least one of said second and third final control means.

9. A fuel injection pump, as described in claim 1, wherein:

said rpm governor means comprise a shaft connected at one end to said second part of said cam drive means;

said first final control element comprises a control lever, actuated by said final control adjustment means, which is connected to said shaft to position said second part of said cam drive means;

said fuel injection pump further comprising connecting means for connecting said control lever to adjust said second and third final control means.

10. A fuel injection pump, as described in claim 1, wherein said rpm governor means includes:

a tension lever;

a control spring for exerting force on one end of said tension lever;

a starting lever having one end coupled to said fuel supply quantity adjustment means, and an opposite end;

a starting spring, which is disposed between said one end of said tension lever and said opposite end of said starting lever, said starting spring acting in series with said control spring to exert a force on said opposite end of said starting lever, said starting spring being a softer spring than said control spring;

an rpm transducer means for exerting a force proportional to engine rpm on said opposite end of said starting lever to move said starting lever against the force exerted on said starting lever by said control spring and said starting spring, wherein said starting lever drives said tension lever, in the manner of a drag member, after compressing said starting spring;

an adjustable shutoff lever which determines the position of said starting lever and said fuel supply quantity adjustment means upon engine starting when said starting lever is held in engagement with said shutoff lever by the force exerted on said starting lever by said control spring and said starting spring; and said second final control means which comprises a second adjustable stop actuated by said final control adjustment means, for determining the position of said shutoff lever as a function of engine temperature.

11. A fuel injection pump as described in claim 10, wherein said control spring is connected between said tension lever and said adjustment lever.

12. A fuel injection pump, as described in claim 10, wherein said first and second stops are separately actuated by said final control adjustment means.

13. A fuel injection pump, as described in claim 10, wherein said first and second stops are actuated in common by said final control adjustment means.

14. A fuel injection pump, as described in claim 10, wherein:

said rpm governor means comprise a shaft connected at one end to said second part of said cam drive means;

said first final control element comprises a control lever, actuated by said final control adjustment means, which is connected to said shaft to position said second part of said cam drive means;

said fuel injection pump further comprising connecting means for connecting said control lever to adjust said second and third final control means.

15. A fuel injection pump, as described in claim 1, wherein:

said rpm governor means comprises a starting lever connected to actuate said fuel supply adjustment means, said starting lever being movable from a rest position along a predetermined path, the quantity of fuel injected when the engine is started being determined by the rest position of said starting lever; and said final control adjustment means is connected with said starting lever to adjust the rest position of said starting lever in accordance with engine temperature by limiting the path of travel in one direction of said starting lever.

16. A fuel injection pump, as described in claim 15, wherein said rpm governor means includes:

a tension lever;

a control spring for exerting force on one end of said tension lever;

said starting lever having one end coupled to said fuel supply quantity adjustment means, and an opposite end;

a starting spring which is disposed between said one end of said tension lever and said opposite end of said starting lever, said starting spring acting in series with said control spring to exert a force on said opposite end of said starting lever, said starting spring being a softer spring than said control spring;

an rpm transducer means for exerting a force proportional to engine rpm on said opposite end of said starting lever to move said starting lever against the force exerted on said starting lever by said control spring and said starting spring, wherein said starting lever drives said tension lever, in the manner of a drag member, after compressing said starting spring;

an adjustable shutoff lever which determines the position of said starting lever and said fuel supply quantity adjustment means upon engine starting when said starting lever is held in engagement with said shutoff lever by the force exerted on said starting lever by said control spring and said starting spring; and a second adjustable stop actuated by said final control adjustment means for determining the position of said shutoff lever as a function of engine temperature.

17. A fuel injection pump, as described in claim 1, wherein:

said rpm governor means comprise a shaft connected at one end to said second part of said cam drive means;

said first final control element comprises a control lever, actuated by said final control adjustment means, which is connected to said shaft to position said second part of said cam drive means;

said fuel injection pump further comprising connecting means for connecting said control lever to adjust said second and third final control means.

18. A fuel injection pump, as described in claim 1, which further comprises coupler parts for connecting with each other at least two of said first, second, and third final control means.

* * * * *